United States Patent [19]

Right

[11] Patent Number: 4,499,453

[45] Date of Patent: Feb. 12, 1985

[54] POWER SAVER CIRCUIT FOR AUDIO/VISUAL SIGNAL UNIT

[75] Inventor: Robert W. Right, Huntington, Conn.

[73] Assignee: General Signal Corporation, Stamford, Conn.

[21] Appl. No.: 591,889

[22] Filed: Mar. 21, 1984

Related U.S. Application Data

[63] Continuation of Ser. No. 382,881, May 28, 1982, abandoned.

[51] Int. Cl.[3] ..... G08B 27/00

[52] U.S. Cl. ..... 340/326; 340/331; 340/384 E

[58] Field of Search ..... 340/105, 321, 326, 331, 340/333, 384 E, 815.21, 815.22

[56] References Cited

U.S. PATENT DOCUMENTS 4,101,880 7/1978 Haus ..... 340/326
4,115,758 9/1978 Luteran ..... 340/52 R
4,274,084 6/1981 Haus ..... 340/326
4,276,542 6/1981 Russ ..... 340/326

*Primary Examiner*—James J. Groody
*Assistant Examiner*—Michael F. Heim
*Attorney, Agent, or Firm*—Ronald Reichman; Milton E. Kleinman; George W. Killian

[57] ABSTRACT

A combined audio and visual signal unit with the audio and visual components actuated alternately and powered over a single cable pair in such a manner that only one of the audio and visual components is drawing power from the power supply at any given instant. Thus, the power supply is never called upon to provide more energy than that drawn by the one of the components having the greater power requirement. This is particularly advantageous when several combined audio and visual signal units are coupled in parallel on one cable pair. Typically, the signal unit may comprise a horn and a strobe light for a fire alarm signalling system.

14 Claims, 1 Drawing Figure

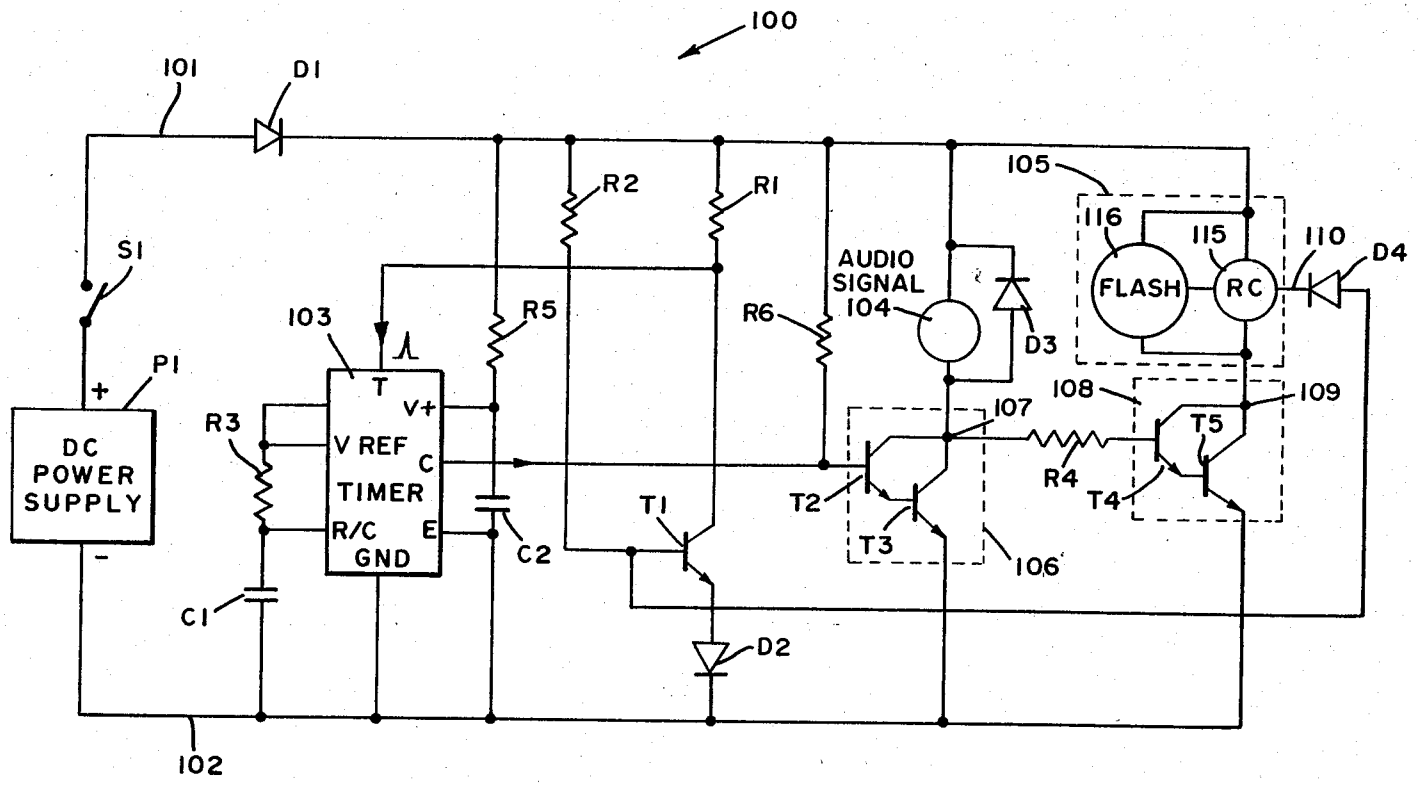
100
D4
110
109
RC
115
FLASH
116
105
T5
T4
108
R4
D3
107
106
AUDIO SIGNAL 104
T3
T2
R6
R1
D2
T1
R2
R5
C2
T
V+
C
E
V REF
TIMER
R/C
GND
103
D1
R3
C1
101
102
S1
P1
+
-
DC POWER SUPPLY

POWER SAVER CIRCUIT FOR AUDIO/VISUAL SIGNAL UNIT

This application is a continuation of application Ser. No. 382,881 filed on May 28, 1982, now abandoned.

BACKGROUND OF THE INVENTION

One of the most frightening experiences a person can have is to be inside a large building and learn that there is a fire. In order to give people an early notice and a chance to escape to the outside, it has been conventional to provide some type of an alarm when fire conditions exist. Many decades ago, such alarm was given merely by the first person observing the condition to shout "fire" and the shout would be taken up by others. As our society has become more complex and our technology has become more sophisticated, it has become conventional to provide a wide variety of detectors located in several positions which are capable of initiating audible and/or visual signals to warn people. As buildings become larger and especially high-rise, the detecting devices and alarm signals have become quite sophisticated.

In recent years, it has been considered desirable to provide both visual and audible alarm signals and legislation has been passed in some jurisdictions requiring both audible and visual alarms. This is considered desirable as deaf people cannot hear an audible alarm and blind people will not recognize a visual alarm. It has also been found that intermittent operation of the audio and visual signal is a superior means for gaining attention and response.

In large enclosed areas, such as a shopping mall, and/or in multi-story buildings, it is frequently necessary to provide many visual and audio signals. Although the amount of power consumed by each unit is not particularly significant designers of such equipment have recognized that they could use a smaller and more economical power supply if it were practical to control the maximum number of devices which were connected at any given instant. For example, the capacity of the power supply could be cut in half if it were possible to have the duty cycles of the alarms arranged so that while one half of them is activated, the other half is inactivated and vice versa. With the use of both visual and audible components, it was recognized that further savings could be made in the power supply system if the audio component was energized while the visual component was not and vice versa. It is fairly obvious that such a technique could be readily implemented by coupling the audio devices in parallel on one cable pair and the visual devices in parallel on another cable pair. However, it is equally obvious that this may result in a cost trade-off wherein the extra cable pair is as expensive as providing the larger capacity power supply.

The structure of the present invention is provided to permit the use of an economical power supply without requiring the use of an extra cable pair.

U.S. Pat. No. 3,431,470 issued Mar. 4, 1969 to Stiebel et al teaches a means for excercising accurate control of the time period during which an alarm is activated. With this accurate timing, one could devise a system wherein groups of alarms could be activated during non-overlaping time periods.

U.S. Pat. No. 3,456,251 issued July 15, 1969 to G. E. Smith et al teaches a plurality of intermittent visible and/or audible indication devices all controlled by a single circuit. However, the control is not exercised over a single pair of wires.

U.S. Pat. No. 3,478,345 issued Nov. 11, 1969 to Greenwald teaches a system using cam pins in slots on a rotating drum to control a timing sequence of audio visual signals. This system, if used to minimize maximum instantaneous power consumption, would require the use of multiple leads as aforedescribed.

U.S. Pat. No. 3,872,471 issued Mar. 18, 1975 to Bird et al discloses a bell with self contained timing means for intermittent actuation. If a plurality of these two terminal devices were used on a single cable pair, there would be no way to assure that they might not all be activated at any given instant, and therefore, power supply capable of providing sufficient energy to operate all of them would be required.

SUMMARY OF THE INVENTION

In accordance with the present invention, a plurality of signal units are contemplated as being coupled in parallel on a single cable pair. Preferably, the signal unit comprises two distinct components, each of which provides an independent signal. These could include a horn, bell, siren, incandescent lamp, a xenon flash lamp or other device. Usually, the signal will include one audio device and one visual device. In the illustrated embodiment, the audio and visual devices are a horn and a xenon flash lamp. Power for actuating the audio component and the visual component is drawn from the cable pair. Control means are provided whereby the audible component is coupled to the line for a predetermined period of time and in response to the termination of that time, the visual component is coupled to the line. Because of the high intensity light and relatively low power requirements, the use of a strobe light for the visual indication component is anticipated, however, other light sources could be used. In a strobe light system, the capacitor of an RC network is charged until a threshold potential is reached. In response to the capacitor being charged to the threshold potential, a signal is provided which triggers the strobe light thereby emitting a visual indication. The same signal, or one produced in response thereto, is applied to the timing device which recouples the audio component to the line for the predetermined period of time. By this means, the visual and audio signals are alternately coupled to the line; and the power supply is never called upon to provide power to both the audio and visual components simultaneously. Accordingly, the power supply need not be able to provide any more power than the power required by the component of the signal which requires the greater power multiplied by the number of units on the line. Typically, the audio device may require more power than the strobe light. Additional savings in the capacity of the power supply may be achieved by careful selection of the audio component to provide one which produces the required audio level with minimum power consumption.

Each signal unit will comprise an audio device, a visual device and its own timer. Accordingly, the plurality of units on the cable pair will not necessarily be operating in synchronism.

Because the visual indicator, if a strobe unit, does not flash until the associated capacitor is sufficiently charged, and since the start of the flash also initiates the application of energy to the audio component, the observer will see a flash which appears to start simultaneous with the sound. The retentive power of the eye makes the visual signal appear to last longer than its actual duration and therefore, the normal human perception is that the visual signal and the audible signal are coexistent. Notwithstanding this apparent simultaneous display of visual and audible signals, power is supplied to only one of the audio and visual components of a signal unit at any instant of time.

By this means, a more economical power supply unit can be provided and, perhaps more importantly, the reserve battery supply for emergency operation need not be as large as if the various components were not controlled as described.

From the foregoing, it will be seen that it is an object of the invention to provide a new and improved power saver circuit for signal units comprising both audio and visual components.

It is a more specific object of the invention to provide a control circuit individual to each signal unit which couples the audio component to the cable pair for a predetermined period of time and which then couples the visual component to the cable pair.

It is a another object of the invention to automatically restart the audio component and the associated timer in response to actuation of the visual component.

It is another object of the invention to provide a system wherein the maximum power drawn from the power supply is smaller than in prior art systems using identical audio and visual components.

It is another object of the invention to provide the power to the signal units over a single cable pair.

It is another object of the invention to provide the described controls using economical, compact and reliable solid state components.

Other objects and advantages incident to the invention will be referred to, or else will become apparent from, the specification which follows.

BRIEF DESCRIPTION OF THE DRAWING

To permit incisive and detailed analysis of the operational characteristics of this invention, a single FIGURE of a schematic drawing showing specific circuitry is provided. This drawing discloses one form of the invention and is not meant, in any way, to delimit its scope. It is rather so drawn as an aid in an understanding of the invention. Standard electrical symbols are used and are further explained in the specification.

DESCRIPTION OF THE PREFERRED EMBODIMENT

Considering now the schematic diagram of an embodiment of the invention, it will be seen that conventional symbols have been used for resistors, transistors, diodes, and capacitors. As a convenience and a memory aid, item numbers assigned to such elements will be given an initial letter indicative of the nature or character of the element.

While this circuit could have been designed to operate on other voltages, a specific embodiment has been designed to function with a DC potential within the range of approximately 4.5 to 40 volts. The power supply P1 may be batteries or it may be a filtered or unfiltered DC potential. A wide range of operating potentials is desired because the potential of the power supply P1 may vary and in addition, one or a plurality of the devices may be coupled in parallel on a long cable pair resulting in reduced voltage to the more remote units. Further, in order to permit use of more economical power supplies, the circuit has been designed to function with a power supply that exhibits considerable ripple.

During the non-alarm condition, a reverse potential may be applied to the power supply leads 101 and 102, by a means not shown, for supervision purposes. The diode D1 keeps this reverse potential supervision signal from activating any of the illustrated components.

When conditions prevail which make it desirable to actuate the alarm device, indicated generally as 100, switch S1 will be closed and a positive potential from power supply P1 will be applied to lead 101 and a negative potential will be applied to lead 102. As stated, the applied power may be either filtered or unfiltered DC and may range from 4.5 volts to 40 volts, or other limits with modified design.

The alarm device 100 includes a timer 103, a horn 104 and a strobe circuit 105 in addition, a variety of resistors, capacitors, transistors and diodes are included. As the description develops, it will be seen that in response to application of power to the leads 101 and 102, the timer 103 will be activated and it will initiate a timing period having a predetermined duration. During the timing period of predetermined duration, the horn 104 wil be energized and will sound. At the conclusion of the predetermined timing period, the horn 104 will be turned off and power will be applied to the strobe circuit 105. The strobe circuit 105 comprises a conventional strobe circuit including an RC network 115 including a capacitor which is charged to a predetermined potential and when such predetermined potential is reached, the light emitting element 116 of the strobe circuit will provide a brilliant flash of very brief duration. When the flash circuit is triggered, a pulse will be provided for restarting the timer circuit 103. Thus, it will be seen that during the on-time of the timer 103, the horn 104 will be activated and the strobe 105 will be deactivated. At the conclusion of the on-time of the timer 103, the horn 104 will be turned off and power will be applied to the strobe 105 and when associated capacitors are sufficiently charged, the xenon lamp 116 will flash and a pulse will be generated to restart the timer 103. By this means, it will be seen that power is connected to only one of the horn 104 and the strobe 105 at any instant of time. That is, power is never provided to both units simultaneously and therefore, the power supply P1 which is connected to leads 101 and 102 is not required to be capable of providing any more power than the amount required by the one of the units 104 or 105 which has the greater power requirement multiplied by the number of alarm devices 100 which may be connected to the power supply P1 at any one time. This will permit the use of a more economical power supply unit.

As described, it would appear that the horn 104 and the strobe 105 are actuated alternately and indeed, this is the fact. However, during the silent period of the horn 104, the strobe circuit 105 is charging a capacitor in the RC network 115 and no light is being emitted by the flash tube 116. When the RC network 115 charges to a threshold potential, the xenon tube 116 flashes and there is a brilliant but brief light display. The retention of the human eye is such that the duration of the light will appear to be considerably longer than it actually is. The result is that since the horn 104 is activated almost simultaneously with the production of the light output that the human observer will perceive that the light and horn start at substantially the same time.

Considering now the circuit operation of the alarm device 100 in more detail, it should be understood that when an alarm signal is to be produced, a positive potential is connected from power supply P1 to lead 101 and a negative, or ground potential, is connected to lead 102 in response to closing switch S1 which may be actuated by any of a wide variety of control or detecting devices. Closing switch S1 connects positive potential through resistor R5 to the V+ terminal of the timer 103 and negative potential to the GND and E terminals of the timer 103. Concomitantly, power is coupled to a start control circuit including resistors R1 and R2 and transistor T1. The positive potential on lead 101 will pass through diode D1 and resistor R1 to apply a positive potential at the junction between resistor R1 and the collector of transistor T1 and concomitantly to the T terminal of timer 103. The positive potential on the T terminal of timer 103 provides a start signal to the timer 103. Simultaneously, the positive potential through resistor R1 will be applied to the collector of transistor T1 while the base thereof is held at a positive potential through resistor R2 while the emittor is at ground through diode D2. Accordingly, the transistor T1 turns on but takes a brief time to do so due to the interelectrode capacitance. As soon as transistor T1 turns on, the lower terminal of R1 is pulled down to ground potential; or phrased differently as soon as transistor T1 turns on the T terminal of timer 103 is shifted from a positive potential to a negative potential thereby ending the start signal on the T terminal to the timer 103. Or in other words, in response to the closure of switch S1, a start signal comprising a brief positive pulse is applied to terminal T of timer 103. In response to the application of the start signal to the trigger or T terminal of the timer 103, which may comprise an element such as national semiconductor timer module LM2905, the timer will respond by removing a negative or ground potential from the control or C lead of the timer 103 which then rises to the positive potential through resistor R6. At the end of the timing period, the time of which is controlled by means to be described more fully hereinafter, the timer 103 will reconnect the C terminal to ground to which the E and GND terminals of timer 103 are connected. While the C terminal of the timer 103 is at positive potential, this is applied to the base of transistor T2 which, together with transistor T3 comprises a Darlington circuit as indicated generally by 106, and which serves as an activation circuit for the audio device 104. The positive potential applied to the base of transistor T2 allows current through the emittor base junction of T2. A single transistor circuit could be used in place of the Darlington circuit 106 if the horn 104 was a low current device. With transistor T2 turned on, transistor T3 is turned on and current flows through the horn from lead 101 through the horn 104 from the collector to the emittor of transistor T3 to the ground at lead 102. The Darlington circuit 106 will be maintained in the conducting condition so long as the timer 103 provides an open collector output on the C lead.

Considering now more specifically the timing control on the timer 103, the time that the control lead C lead is held in the open collector condition will be a function of the time constant comprising the resistor R3 and capacitor C1 which are connected to the timer 103 terminals V REF and R/C in the manner shown. By increasing the values of either or both the resistor R3 and capacitor C1, the open collector time of terminal C may be increased and conversely reduction in the values of resistor R3 or capacitor C1 will result in a reduction of the open collector time of terminal C. In an alarm condition, a relatively rapid audible repetition rate is desired and therefore, in one embodiment of the structure, the time constant of the R3-C1 combination was set to approximately 250 milliseconds. Other times could be used as may be expedient.

With the Darlington circuit 106 turned on, under control of the open collector lead C of the timer 103, terminal 107 will be at substantially ground potential, i.e., the potential of lead 102. This ground potential will be applied through resistor R4 to the base of transistor T4 which together with transistor T5 comprises another Darlington indicated generally as 108 and which serves as an actuation circuit for the strobe circuit 105. With the Darlington 108 held turned off, the terminal 109 is held above ground potential and no current can flow through the strobe circuit 105. For the timing interval of the timer 103, namely while the C lead is held open, the horn 104 will be activated and will produce an audible sound. As soon as the timing interval, as controlled by resistor R3 and capacitor C1, has elapsed the C lead of the timer 103 will be coupled to the E lead and to ground thereby turning off the Darlington circuit 106 since the base of transistor T2 will no longer be at a positive potential. As a result, the audible output of the horn 104 will be terminated.

The horn 104 may include interrupter contacts to repetitively actuate and deactivate the horn 104 at a relatively high rate as compared with the timing period controlled by the timer 103. Opening the interrupter contacts (not shown) can, as is well known to those familiar with such devices, cause the generation of a reverse inductive potential. In order to protect the interrupter contacts and to absorb the energy from the reverse inductive potential, diode D3 is provided. Other techniques which are well-known to those familiar with such devices may be used to absorb the inductive energy.

As soon as the Darlington 106 is turned off, terminal 107 is pulled up to positive potential through the circuit of the horn 104. This positive potential will be applied through resistor R4 to the base of transistor T4 thereby turning on the Darlington circuit 108. With the Darlington circuit 108 turned on, current will flow from the lead 101 through diode D1, the strobe circuit 105, the collector to emittor circuit of transistor T5 to the ground at lead 102.

The strobe circuit 105 may comprise any of a variety of conventional strobe circuits and is not shown in detail as the inclusion of such details would unnecessarily clutter the drawing and tend to obscure the inventive concept. However, as is well-known to those familiar with strobe circuits, when energy is applied thereto, a circuit 115 is provided for charging a capacitor to a sufficiently high voltage to pass a threshold voltage required to trigger the xenon strobe unit 116 and produce a light output. As previously stated, and as is typical of strobe units, the light output will be very intense but of a very brief duration which may range from approximately 1 microsecond to 10 milliseconds. The time required to charge the capacitive network 115 within the strobe unit 105 will be a function of the design of that unit and could range from a fraction of a second to several seconds or more. In an embodiment of the invention, the time was set to be of the same order of magnitude as the open collector time of the C terminal of the timer 103. That is, the time to charge the capacitors and initiate the generation of a flash signal may be of the order of 250 milliseconds. In response to the triggering of the strobe unit 116 to flash, a ground pulse is placed on lead 110 and as a result, the base of transistor T1 is placed at substantially ground potential and turns off. After the strobe 116 has flashed, ground will be removed from the lead 110 and another positive pulse from resistor R1 will be applied to the timer terminal T of the timer 103 during the turn on time of transistor T1 all in the manner as previously described. In response to the generation of a new timer pulse to the timer 103, the C lead of the timer will assume an open circuit condition and the Darlington 106 will again be turned on all in the manner previously described.

The described cycles will repeat until the activating power supply is disconnected from the leads 101 and/or 102. That is, the positive pulse supplied to the T terminal of the timer causes the Darlington 106 to turn on which, in turn, allows energizing of the horn 104. During the time that the horn 104 is energized, the Darlington 108 is held off. Accordingly, the horn 104 and the strobe 105 cannot draw power simultaneously. At the conclusion of the timing interval of the timer 103, the C lead will be returned to ground thereby turning off the Darlington 106 and allowing the Darlington 108 to turn on. With the Darlington 108 turned on, energy will flow to charge the resistor-capacitor unit 115 to the threshold potential and flash the strobe 116. Simultaneously with the flash of the strobe 116, ground will be applied to lead 110 which will result in a brief turn off of transistor T1 which will allow the terminal at the lower terminus of resistor R1 to be raised to a positive potential and initiate another cycle of operation. It should be noted that timer 103 is turned on by a brief pulse at terminal T but that most of the timing period, and subsequent to the timing period, terminal T is at negative potential with transistor T1 turned on.

The diode D4 coupled to the strobe unit 105 provides isolation and prevents high potential from the strobe unit being applied to the transistor T1. The diode D2 provides a threshold potential for the initial triggering of transistor T1. Resistor R5 provides current limiting to the timer 103 and capacitor C2 maintains a potential to the timer 103 if the DC power supply P1 is unfiltered.

In one embodiment of the invention, the following values were used:

| Element Number | Value |
|---|---|
| R1 | 100K ohms |
| R2 | 100K ohms |
| R3 | 2.4 Megohms |
| R4 | 47K ohms |
| R5 | 4.7K ohms |
| R6 | 47K ohms |
| C1 | 0.1 microfarads |
| C2 | 4.7 microfarads |

Although this invention has been described as used in combination with an alarm device comprising an audio device and a light emitting element, it will be obvious that the principles could be applied to any system wherein it is desired to alternately operate two devices.

While there has been shown and described what is considered at present to be the preferred embodiment of the invention, modifications thereto will readily occur to those skilled in the related arts. For example, in another structure, the horn 104 could comprise an amplifier and loud speaker circuit, an incandescent light source could be substituted for the strobe 105, and other time constants used. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described and it is intended to cover in the appended claims all such modifications as fall within the true spirit and scope of the invention.

What is claimed is:

1. A combined audio visual alarm device having audio and visual components activating relatively simultaneous so that at any given time either the audio or visual component will alternately draw power from a power source, so that at a given period of time the audio signal will be either clearly sounding, or not sounding, while providing an audible signal whose tone, i.e. amplitude, frequency and quality is uneffected by said visual components, said device comprising:

(a) an audible device;

(b) a light emitting device;

(c) timing means for producing a control signal of predetermined duration in response to a start signal;

(d) a power supply;

(e) start control means coupled to said timing means and said power supply for controlling the production of said start signal and coupling same to said timing means, in response to the connection of said power supply to said start means;

(f) said control signal being coupled to an audible device activation circuit for coupling said audible device to said power supply for the predetermined duration of said control signal;

(g) a light emitting device actuation circuit coupled to said audible device activation circuit for coupling said light emitting device to said power supply in response to the termination of said control signal; and wherein (h) said light emitting device produces a pulse subsequent to said light emitting device being coupled to said power supply and which pulse is coupled to said start control means for initiating the generation of another signal whereby said power supply will at any given time only draw the power required by said audible device or said light emitting device, to conserve power.

2. The combination as set forth in claim 1 wherein said light emitting device includes an RC circuit for storing energy derived from said power supply while said light emitting device is coupled to said power supply.

3. The combination as set forth in claim 2 wherein said RC circuit stores energy between the production of successive ones of said control signals whereby said power supply alternately provides power to said audible device and said RC circuit of said light emitting device.

4. The combination as set forth in claim 3 wherein said RC circuit stores energy while said light emitting device actuation circuit is coupled to power supply and releases the stored energy to a flash lamp included in said light emitting device when the stored energy has reached a threshold level.

5. The combination as set forth in claim 4 wherein said pulse from said light emitting device is not generated until said threshold level of stored energy has been achieved.

6. The combination as set forth in claim 5 wherein said pulse is of brief duration, as compared with the duration of said control signal.

7. The combination as set forth in claim 6 wherein in response to the generation of said pulse a new start signal is generated.

8. The combination as set forth in claim 1 wherein said audible device activation circuit includes means for disabling said light emitting actuation circuit while said audible device activation circuit couples said audible device to said power supply.

9. The combination as set forth in claim 8 wherein said audio device is included in an enabling circuit for said light emitting device actuation circuit.

10. The combination as set forth in claim 1 wherein said control signal is an open collector circuit when it causes said audible device activation circuit to couple said audible device to said power supply.

11. The combination as set forth in claim 10 wherein said control signal comprises a ground signal subsequent to said predetermined duration.

12. The combination as set forth in claim 1 and including means for altering said predetermined duration.

13. The combination as set forth in claim 1 wherein said start control means includes a transistor for controlling the production of said start signal with the base of said transistor coupled to a first resistor which is coupled to the positive power supply and the collector of said transistor is coupled to a second resistor which is coupled to the positive power supply, and with the emitter of said transistor being coupled to the negative power supply.

14. The combination as set forth in claim 13 wherein said start signal comprises a positive potential at the collector of said transistor during the off time of said transistor.

* * * * *